United States Patent [19]

Kobler et al.

[11] Patent Number: 4,681,035

[45] Date of Patent: Jul. 21, 1987

[54] ROTARY OFFSET PRINTING MACHINE SYSTEM

[75] Inventors: Ingo Kobler, Anhausen; Josef Plantsch, Augsburg, both of Fed. Rep. of Germany

[73] Assignee: M.A.N.-Roland Druckmaschinen Aktiengesellschaft, Offenbach am Main, Fed. Rep. of Germany

[21] Appl. No.: 838,143

[22] Filed: Mar. 10, 1986

[30] Foreign Application Priority Data

Mar. 14, 1985 [DE] Fed. Rep. of Germany ..... 3509044
Mar. 14, 1985 [DE] Fed. Rep. of Germany ..... 3509045

[51] Int. Cl.[4] ..... B41F 5/22
[52] U.S. Cl. ..... 101/217
[58] Field of Search ..... 101/401.3, 401, 401.2, 101/415.1, 177, 217, 142, 137; 428/909

[56] References Cited

U.S. PATENT DOCUMENTS 1,471,895 10/1923 Huebner ..... 101/217
2,085,845 7/1937 Binkley ..... 101/401.3 X
3,261,289 7/1966 Cash et al. ..... 101/217
3,391,637 7/1968 Reynolds et al. ..... 101/401.3
4,042,743 8/1977 Larson ..... 101/401.1 X

*Primary Examiner*—J. Reed Fisher
*Attorney, Agent, or Firm*—Frishauf, Holtz, Goodman & Woodward

[57] ABSTRACT

To compensate for oscillations and bending of a blanket cylinder, and particularly oscillatory behavior under specific operating speeds, underlays between the rubber blanket and the cylinder surface are provided which are of differential thickness, so that, at any given operating speed where the blanket cylinder tends to move away from an associated impression cylinder, the underlay is thickened to thereby maintain essentially uniform printing pressure against the printing substrate (5) under all conditions. The system is equally applicable for plate cylinder - blanket cylinder systems of uniform diameter, as well as for plate cylinder - blanket cylinders of different diameter, and, in the latter case, preferably utilize an underlay blanket which tapers uniformly from a thinner portion to a thicker portion beneath the printed subject matter transferred to the blanket cylinder upon the second revolution of the plate cylinder.

12 Claims, 9 Drawing Figures

Fig. 1
PRIOR ART
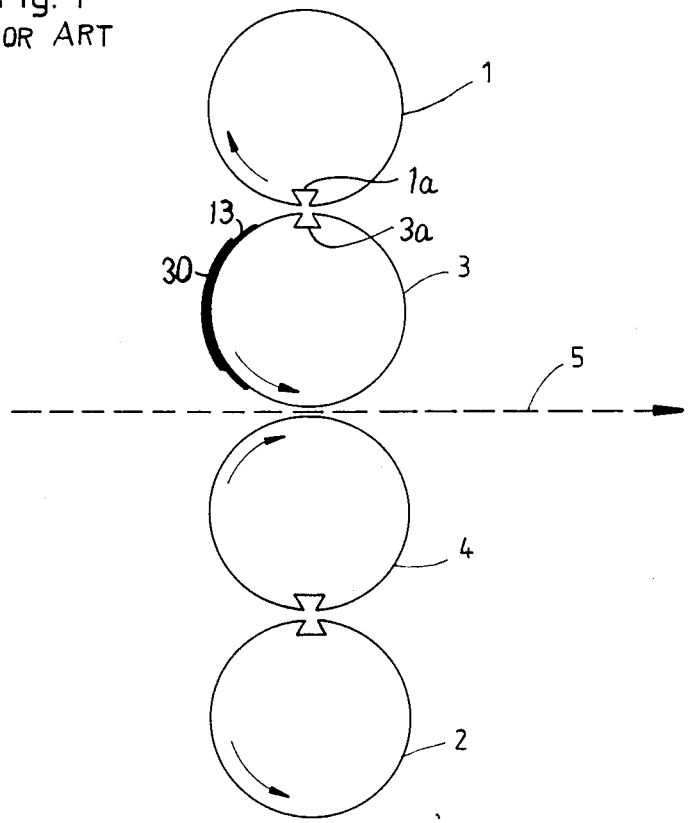
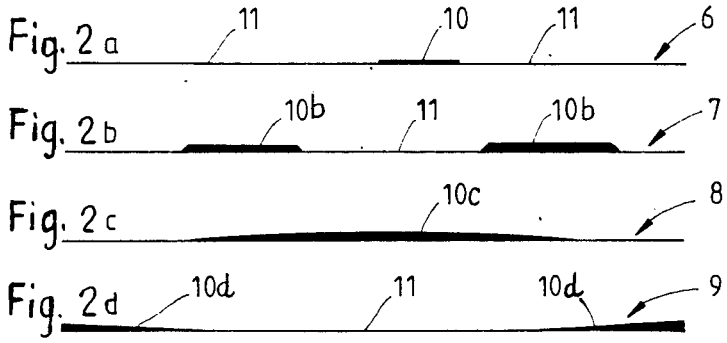

Fig.3
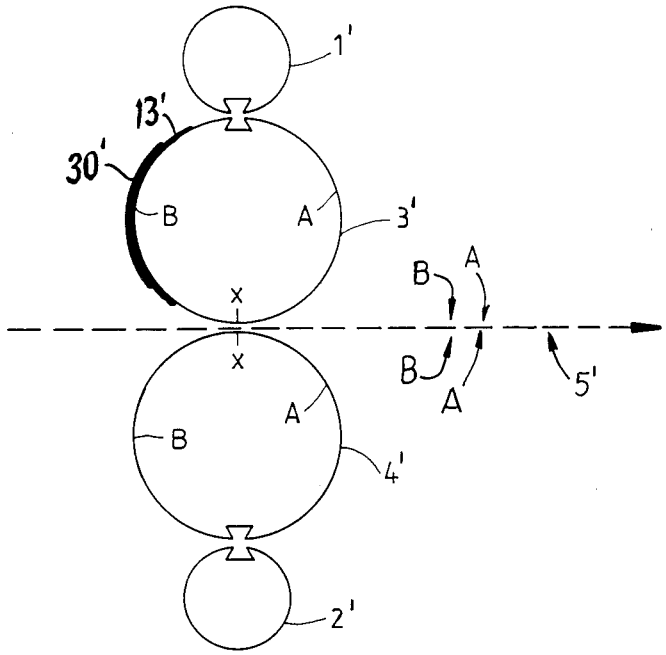
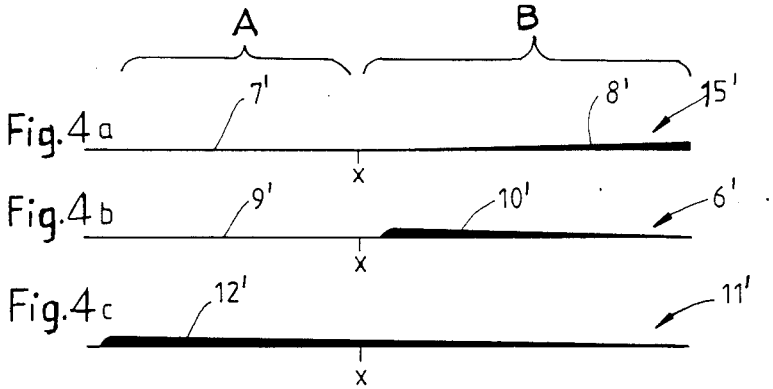

ROTARY OFFSET PRINTING MACHINE SYSTEM

The present invention relates to rotary offset printing machines, and more particularly to an arrangement to improve the quality of printed products, and the uniformity thereof, delivered by the printing machine system.

BACKGROUND

Rotary offset printing machines in which a plate cylinder together with a rubber blanket cylinder forms a printing couple are well known. It has been found that at high speeds of rotary printing machines—which may print on an elongated web or on sheets—cylinders tend to oscillate or otherwise not run exactly as intended, and the result of oscillation or otherwise differential behavior of the cylinders during printing results in printed copy which should be improved. Striations, stripings, differential inking and the like may be noticed. Printing machine cylinders, particularly blanket cylinders and plate cylinders, are excited to oscillate especially when the grooves in the cylinders in which the plates and the blankets are clamped run off against each other. Additional oscillations can be derived due to the drive gearing, that is, when meshing gears change from engagement of flanks of the gear teeth. Driven inkers and dampers, likewise subject to change in engagement of the flanks of the gear teeth, also may contribute to oscillatory behavior of printing cylinders. Many attempts have been made to prevent non-uniformity in printing, for example due to oscillation, see, for example, the following published patents:

Fed. Rep. Germany Pat. No. 26 13 688

Fed. Rep. Germany AS No. 11 93 516

Fed. Rep. Germany Pat. No. 11 93 516

German Dem. Republic (East Germany) Pat. No. 101,335

In spite of many and extensive attempts, it has not been possible to entirely eliminate the effects of non-uniform rotation on printed subject matter. The various proposals which have been made—see the referenced patents, for example—were intended to suppress oscillations by directly affecting the respective cylinder. It is, of course, always possible to very accurately balance each individual cylinder in a printing machine system and arrange the balance with respect to all other printing cylinders. This, however, is extremely expensive and, in mass production, while balancing of the individual cylinders as they are made is part of the manufacturing process, a re-balancing of individual cylinders in any system then would be necessary. Furthermore, the behavior of the cylinders at different speeds differs, so that balancing the cylinders for all speeds is not always possible. Within specific series of printing machines which are made, similar efforts are undertaken for all the machines to balance the cylinders and to avoid vibrations and oscillations. It is always possible, however, that a specific machine of a series differs in its oscillatory characteristics from all the other machines of the similar series. Individual correction and rebalancing of such a machine is very difficult and costly.

Various types of printing machines use rubber blanket cylinders which have a diameter larger than the diameter of the associated plate cylinder, for example twice the diameter. In such a machine, the plate cylinder revolves twice for each revolution of the rubber blanket cylinder, so that the rubber blanket cylinder will have two identical printed image information offset thereon. It has been found that there may be qualitative differences between the printed image transferred from such a rubber blanket cylinder which, for example, may be a difference in intensity or inking of a printed image transferred from one half of the rubber cylinder with respect to the adjacent half of the rubber cylinder, resulting from the second roll-off of the plate cylinder thereagainst.

It is known to provide rubber blankets, stretched on rubber blanket cylinders, with underlays, or underblankets.

THE INVENTION

It is an object to improve printing machine systems such that the printed goods will have printed subject matter thereon which is improved by eliminating, or at least substantially reducing and rendering ineffective, oscillatory conditions of the printing cylinder-blanket cylinder combinations.

Briefly, a rubber blanket underlay is located between the rubber blanket on the blanket cylinder and the surface of the blanket cylinder which is non-uniform throughout its longitudinal extent as it is applied on the blanket cylinder.

In order to reduce vibrations, and in accordance with a feature of the invention, the rubber blanket underlay has regions of greater or lesser thickness, in which the arrangement of the respective regions of greater or lesser thickness—with respect to the position of the regions on the blanket, and the extent of the regions on the blanket—is matched to and associated with the oscillation characteristics of an individual machine system operating at some given speed, such that the effects of bending oscillations of the blanket cylinders are reduced or eliminated.

The blanket may have a plurality of thickened and thinned regions or may taper from a thinner to a thicker region and taper off again to a thinner region at the end thereof or, conversely, may have thicker regions at the end portions where it is clamped to a clamping groove, and thinner regions therebeyond. In accordance with another feature of the invention, and particularly when used with blanket cylinders which have twice the circumference of the plate cylinder, the rubber blanket may have a tapering configuration, in which the thickness of the rubber blanket either gradually decreases from a leading point thereon towards the trailing point, or, for example, conversely increases from a leading point to a trailing point. The edge of the respective leading points may be either at the beginning of the blanket or, in some embodiments, may be located at half the circumference, that is, at the point where the plate cylinder rolls off against the rubber blanket cylinder a second time.

DRAWINGS

FIG. 1 is a highly schematic diagram of two plate cylinder -offset blanket cylinder printing couples printing on a substrate, in accordance with the prior art;

FIG. 2*a* is a schematic diagram of the longitudinal extent of a blanket underlay used in the system of FIG. 1;

FIGS. 2*b*, 2*c* and 2*d* are illustrations of different embodiments, in side view, of a blanket underlay;

FIG. 3 is a schematic side view of a printing system in which the blanket cylinder has twice the diameter of the plate cylinder; and FIGS. 4*a*, 4*b* and 4*c* are side views of blanket underlays used in the system of FIG. 3.

DETAILED DESCRIPTION

The printing machine system of FIG. 1 utilizes a first plate cylinder-blanket cylinder combination or couple 1, 3, and a second plate cylinder-blanket cylinder combination or couple 2, 4. The respective blanket cylinders 3, 4 act also as impression or printing cylinders for a web or substrate 5, typically a paper web or paper sheets on which printing is to be carried out.

The blanket cylinders 3, 4 have located thereon an underlay sheet or blanket 13 above which a rubber printing blanket 30 is located. The plates on the plate cylinders 1, 2 and the blankets on the blanket cylinders 3, 4 are clamped in conventional axially extending clamping grooves by conventional clamping arrangements. The clamping grooves are identified only at positions 1*a*, 3*a* for simplicity and clarity of the drawing. The arrangement is entirely conventional.

The invention is based on the realization that printing machines of a series of machines, for example of the same model, dimension and the like, have essentially similar oscillatory characteristics. On and beyond these common characteristics, however, any printing machine of the series may have an individual oscillatory characteristic with respect to that of any of the others, which, further, is speed dependent. This can be easily determined by checking the printed copy printed on diffferent machines of the same series or model, and made under different conditions of operating speed. It has been found that there are differences in intensity of inking which vary in accordance with position and strength depending on the operating speed of the machine. In accordance with the present invention, and based on the analysis of printed subject matter, underlay blankets 13 were devised which, taken in the circumferential direction of the respective cylinders 3, 4, have different thicknesses.

Referring to FIGS. 2*a*–2*d*, which illustrate side views of printing blankets: for any machine, and for selected operating speeds of the machine, special underlays 6, 7, 8, 9 were made. In accordance with the present invention, the position of variation of intensity of printing ink on the printed subject matter 5 is determined; striping of the subject matter is then determined and, in dependence on the position and intensity of the striping, the underlay 13 is constructed, as shown in FIGS. 2*a* to 2*d*, by providing underlays of different thickness regions, specifically designed for operation with a specific machine at a specific speed or speed range.

FIG. 2*a* illustrates an underlay 6 for a specific machine at a given speed which has two long regions 11 which are comparatively thin and a somewhat thickened region 10 therebetween. The thickness of the region 10, and the position of the region 10, will be so placed that, at the particular speed, the cylinders 3, 4, between which the printed copy 5 is passed, would tend to separate or oscillate away from each other. The thickened region 10 counterbalances the slight movement of the cylinders away from each other to maintain uniformity of contact engagement of the surface of the blanket 30 on each one of the cylinders 3, 4. If the thickened region 10 would not be present, the printing impression force between the two cylinders 3, 4, at the particular oscillatory point at which the cylinders 3, 4 oscillate away from each other, would be reduced and, due to the reduced pressure, transfer of ink on the copy element 5 would likewise be reduced and the intensity of inking of the copy 5 would be reduced. The thickened region 10 on the underlay 6 counteracts the decrease in pressure between the cylinders.

FIGS. 2*b*, 2*c* and 2*d* show, respectively, other embodiments of underlays 7, 8, 9, having thin regions 11 and thick regions 10*b*, 10*c*, 10*d*, respectively, intended to be used for example with different machines, or with the same machine at different speeds in accordance with the oscillatory pattern of the particular cylinder in the machine. The oscillatory pattern can be readily determined by running a test copy at the intended operating speed, and determining uniformity of inking. In the region where the inking appears thinner or fainter, the underlay should be provided with an increased thickness. FIGS. 2*a* to 2*d* show typical side views of underlay blankets 6–9, respectively. The extent of thickening, and the particular position, is readily determined by a few test runs at the respective speed to obtain an essentially uniformly inked copy 5.

The underlay blanket may be made of various materials, as desired, such as cardboard, plastic, metal, fabric, or the like.

The system has the specific advantage that the expensive metal working of the cylinders 3, 4 is eliminated and, further, a much wider operating speed range is made possible without striping or differential inking of the copy; the effects of the cylinder oscillations can be essentially eliminated without the expensive machining of the printing machine cylinders and, additionally, by merely selecting an underlay from a set of underlays prepared for a specific machine at specific operating speeds provides substantial improvement in the quality of the printing on the printed copy 5. Shaping an underlay blanket to have, for example, the side aspect as shown in the respective FIGS. 2*a* to 2*d* is a simple matter, which can be easily made, by minor material removal, from a flat, easily machined and worked surface, for example of the materials referred to. The heavy steel cylinder forming the blanket cylinders 3, 4 remains untouched and assembled in the machine.

FIG. 3 illustrates another embodiment of the invention in which plate cylinders 1′, 2′ have half the diameter of the associated blanket cylinders 3′, 4′. The copy product 14′ has the same subject matter printed twice, at adjacent locations A and B, also shown on the blanket cylinders 3′, 4′, as the printing regions A, B. Upon one revolution of the blanket cylinders 3, 4, the plate cylinders 1, 2 revolve twice, so that the circumference of any blanket cylinder 3, 4 will carry two identical printed images, transferred to the substrate 5′. Theoretically, the two printed images A, B should be identical. In actual practice, this is not, however, frequently the case, due to the operating behavior of the respective cylinders in the printing system.

In accordance with a feature of the invention, blanket underlays 15′, 6′, 11′ are used, in which, again, the thickness, taken in circumferential direction, differs from a uniform thickness, which was customary practice heretofore. The thickness may vary uniformly throughout the length of the underlay blanket, see FIG. 4*c*, at 12′. In accordance with a preferred feature of the invention, however, the thickness of only that portion of the blanket which is beneath the rubber cover carrying the second printed image B changes in thickness, while the region of the underlay blanket beneath the rubber cover associated with the first printed image A is of uniform thickness, so that the radius of the outer surface of the blanket on the region A will be uniform throughout.

FIG. 4*a* shows the regions 7′, 8′ on the blanket, separated by a theoretical line x, which separates the respective images A, B on the rubber blanket. The radius of the underlay blanket 15′ in the region 7′, which is beneath the first half of the image A, is uniform; in the second region B, the thickness of the underlay, taken in circumferential direction, increases at a uniform rate, in wedge-shaped form, as seen at 8′. FIG. 4*a* illustrates the form of the underlay to be used with a double-diameter blanket cylinder which is most preferred. FIG. 4*b* illustrates another variation, in which the region 9′ beneath the first printing portion A is of uniform thickness, whereas the region 10′ beneath the second portion B decreases from an initially thickened region towards the end thereof. As seen in FIG. 4*c*, the underlay 11′ is constructed in wedge-shaped form as seen at 12′, the wedge-shaped tapering region extending over the entire length of the underlay blanket, that is, over the entire circumference of the respective blanket cylinder 3′, 4′ when placed beneath a rubber blanket.

It has been found that a substantial improvement in quality can be obtained when using blanket underlays as shown in FIGS. 2*a*–2*d* and, for double-diameter blanket cylinders, especially as shown in FIG. 4*a*, the preferred form for this invention, but also as shown in FIG. 4*b*, the next one in order of preference, with the embodiment of FIG. 4*c* being assigned the lowest preference although it may be the easiest to make. The eventual choice will depend on the operating speed of the machine, and where and how non-uniformities in printed output result.

The regions 11 (FIG. 2*a*–FIG. 2*d*) and 7′, 9′ (FIGS. 4*a*, 4*b*) usually and customarily have a thickness of: 1 mm. The regions 10, **10*b*, 10*c*, 10*d*** (FIGS. 2*a*–2*d*) and 8′, 10′, 12′ (FIGS. 4*a*–4*c*) may have a maximum thickness of: 0.5 mm.

Various changes and modifications may be made, and features described in connection with any one of the embodiments may be used with any of the others, within the scope of the inventive concept.

What is claimed is:

1. Rotary offset printing machine system having a plate cylinder (1, 2);

a rubber blanket cylinder (3, 4) in circumferential engagement with the plate cylinder;

a rubber blanket (30) applied over the circumference of the blanket cylinder;

and a blanket underlay (13) located between the rubber blanket and the surface of the rubber blanket cylinder (3, 4), comprising, in accordance with the invention, non-invasive means with respect to the blanket cylinder for eliminating, or at least alleviating, the effects of bending or oscillations of the rubber blanket cylinder including regions formed in the rubber blanket underlay (6, 7, 8, 9; 5′, 6′, 11′) of greater and lesser thickness, in which the arrangement of the respective regions of greater and lesser thickness, with respect to the position of said regions on the underlay, and the extent of said regions on the underlay, in longitudinal direction thereof, which will be circumferential direction when placed about the rubber blanket cylinder, is associated with a bending characteristic of an individual machine system operating at a predetermined speed such that the effects of bending and bending oscillations of the rubber blanket cylinder (3, 4) are effectively compensated with respect to printed copy material (5) by maintaining essentially uniform printing pressure against the copy material and counteracting bending of the respective rubber blanket cylinder by compensatory change in thickness of the underlay.

2. System according to claim 1, wherein the underlay comprises paper, plastic, metal.

3. System according to claim 1, wherein the blanket cylinder (3′, 4′) has twice the diameter as the associated plate cylinder (1′, 2′) to carry, on the circumference of the blanket cylinder, two consecutive printed images (A, B);

and wherein the underlay (13), in circumferential direction with respect to the blanket cylinder is formed with regions of different thickness (7′–8′; 9′–10′; 12′) when positioned beneath the associated rubber blanket (30) and located underneath the zones of the consecutive printed images (A, B).

4. System according to claim 3, wherein, in circumferential direction, the underlay (5′) associated with the first one of the consecutive printed images (A) is of uniform thickness;

and the thickness of the underlay increases, uniformly, in the region in which the underlay is beneath the next consecutive printed image (B).

5. System according to claim 4, wherein the increase in thickness is wedge-shaped.

6. System according to claim 3, wherein, in circumferential direction, the underlay (6′) associated with the first one of the consecutive printed images (A) is of uniform thickness;

and the thickness of the underlay decreases from an increased level, uniformly, in the zone in which the underlay is beneath the next consecutive printing image (B).

7. System according to claim 6, wherein said decrease in thickness is wedge-shaped.

8. System according to claim 3, wherein the underlay has a thickened region at one end thereof and tapers, in wedge shape, to a thinner region at the other end thereof, said underlay extending essentially over the entire circumference of the rubber blanket cylinder (3, 4).

9. System according to claim 1, wherein the underlay, in circumferential direction with respect to the blanket cylinder, is formed with one region of increased thickness extending over a portion of the length of the underlay, only.

10. System according to claim 1, wherein the underlay, in circumferential direction with respect to the blanket cylinder, is formed with a plurality of regions, respectively, which are of greater and lesser thickness.

11. System according to claim 1, wherein the underlay, in circumferential direction with respect to the blanket cylinder, is formed with a zone of increased thickness which tapers uniformly from a thicker median region to thinner portions adjacent the end zones of the underlay.

12. System according to claim 1, wherein the underlay, in circumferential direction with respect to the blanket cylinder, is formed with regions of increased thickness adjacent the end zones of the underlay, tapering towards thinner regions at median portions of the underlay.

* * * * *